United States Patent [19]

Farino

[11] 4,388,931

[45] Jun. 21, 1983

[54] BRASSIERE WITH IMPROVED SEAM

[75] Inventor: Frank G. Farino, Shaker Heights, Ohio

[73] Assignee: Leading Lady Foundations, Inc., Beachwood, Ohio

[21] Appl. No.: 307,104

[22] Filed: Sep. 30, 1981

[51] Int. Cl.[3] ..... A41L 3/00

[52] U.S. Cl. ..... 128/425; 128/515

[58] Field of Search ..... 128/425, 432, 514, 515, 128/516, 517, 467

[56] References Cited

U.S. PATENT DOCUMENTS 1,849,514 3/1932 Eldelmann ..... 128/515

3,062,216 11/1962 Stien ..... 128/467

*Primary Examiner*—Doris L. Troutman

*Attorney, Agent, or Firm*—Body, Vickers & Daniels

[57] ABSTRACT

An improvement in a brassiere of the type having breast receiving cups, each of which is formed from an inner body engaging fabric segment and an outer decorative fabric segment wherein the segments are basted at their peripheries and are each formed from two sections of fabric joined together at a common contour producing seam extending generally across the cup. This improvement is the provision of a seam for each of the segments having a sewed joint between the two fabric sections and defining inwardly folded marginal strips extending away from the joint. These marginal strips are captured between the segments at the contour producing seam to provide both a smooth inner surface and a smooth outer surface.

10 Claims, 6 Drawing Figures

BRASSIERE WITH IMPROVED SEAM

The present invention relates to the art of brassieres and more particularly to a brassiere having an improved contour producing seam in the breast supporting cups of the brassiere.

The present invention is particularly applicable for use in a pre-natal brassiere of the type formed from cotton fabric and it will be described with particular reference thereto; however, the invention has much broader applications and may be used in various other brassieres having contour producing seams extending across the breast receiving and or breast supporting cups.

BACKGROUND OF THE INVENTION

At one time, it was common practice to produce brassieres by providing contoured cups, each of which was formed by two separate sections of material sewed together at a seam extending across the cup. The two joined sections were cut to produce an outwardly protruding fabric structure of the type generally conforming to the size of breast for which the brassiere was specifically sized. Advances in the brassiere art involved forming each cup by two separate contoured segments. These segments have a common seam to produce a desired contour for a given cup. By sewing these two cup-shaped segments together and basting their outer peripheries, a double layered support cup for a brassiere was produced. The inner layer was formed from a fabric selected for its comfort to the woman wearing the brassiere. The outer segment was decorative and was produced from a fabric which provided a pleasing outer appearance, such as lace. The two separate sections of each fabric segment were sewed together at the common contour producing seam. The edges of the two fabric segments were basted together to form a dual fabric cup structure. Contour producing seams were required when using a fabric which did not stretch substantially. The seam itself formed the general shape of the cup. Two of these cups were assembled onto the brassiere structure.

With the advent of various fabrics, including fabrics which could be stretched or molded into a breast receiving shape, many brassieres do not use the contour producing seam extending across the cup. Consequently, a more natural appearance as desired by certain women is obtained. However, this cup construction having no contour producing seam is not useful for cotton fabrics. Cotton of the type used for brassieres can not be molded and formed into a cup configuration without the contour producing seam.

Many women demand that their brassiere be produced from natural fiber, such as cotton. Indeed, some women desire cotton brassieres for less skin irritation. Pregnant women especially require or demand a brassiere having a cotton inner surface so that irritation to sensitive nipples is reduced. Consequently, many prenatal brassieres are manufactured from cotton fabric, especially cotton on the surface of the cup which engages the breast.

When cotton brassieres are manufactured, they require the contour producing seam as previously discussed. In the past, this seam has caused a protrusion on the internal surface of the brassiere. This protrusion extended across the nipple portion of the brassiere and negated some advantages of using cotton fabric. For that reason, cotton pre-natal brassieres having contour producing central seams still produced a certain amount of nipple irritation, even though the cotton forming the inner surface reduces the tendency for irritation.

THE INVENTION

The present invention relates to an improvement in a brassiere, primarily in a pre-natal brassiere of the type having an internal cotton surface for the breast receiving cups, which brassiere has an improved seam to reduce the tendency to irritate the nipple of a wearer, primarily a pregnant woman.

In accordance with the invention, the overlapping contour producing seams of two fabric cup overlays are formed by sewing the overlays separately. Thereafter the marginal edge portions are placed together to capture these marginal edge portions of the seams between the assembled overlays.

The primary object of the present invention is the provision of an improved pre-natal brassiere, which brassiere is easy to manufacture and reduces any tendency to irritate the nipple area of the breast.

Still a further object of the present invention is the provision of an improved brassiere, as defined above, which brassiere is easy to manufacture, has a pleasing internal and external appearance and has reduced components in the contour producing seam areas of the brassiere cups.

Yet another object of the present invention is the provision of a brassiere, as defined above, which brassiere can employ a non-irritating inner fabric material, such as cotton fabric, without the protruding contour producing seam or seams previously experienced in brassieres, especially pre-natal brassieres.

Another object of the present invention is the provision of a brassiere wherein the cups are formed of two overlays or segments, each having contour producing seams with the bulky portions of the seams captured between the overlay.

These and other objects and advantages will become apparent from the following description taken together with the accompanying drawings in which:

PREFERRED EMBODIMENT

Figure 1:
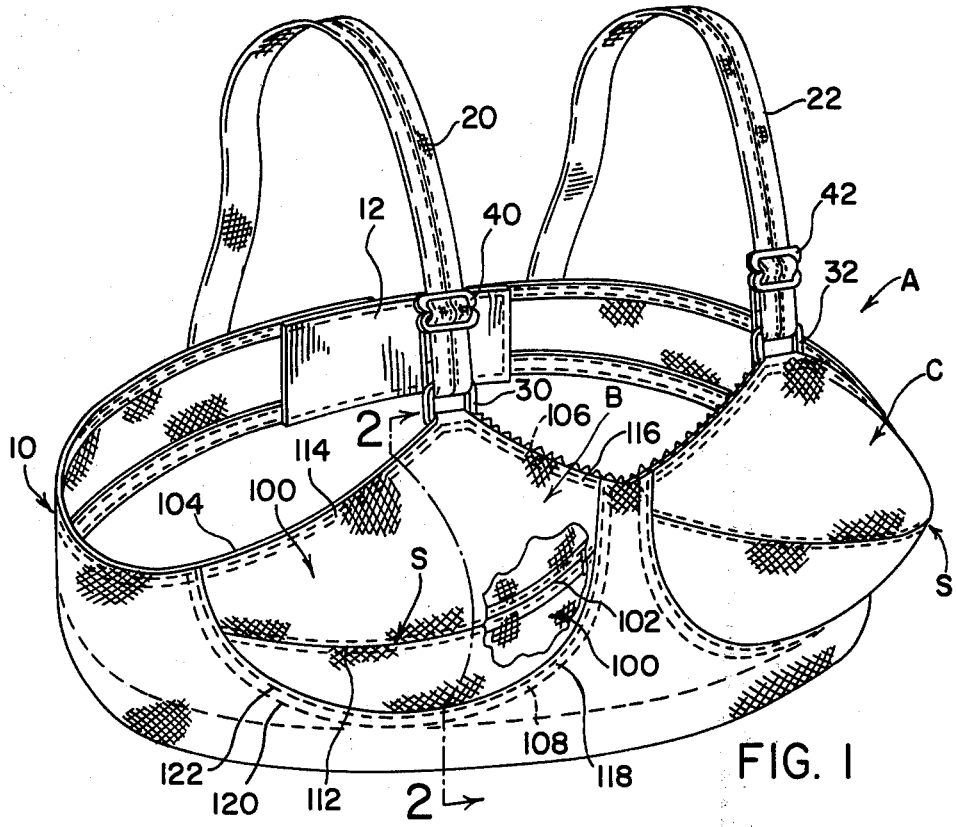
FIG. 1 is a pictorial view of a brassiere employing the preferred embodiment of the present invention.

Referring now to the drawings wherein the showings are for the purpose of illustrating a preferred embodiment of the invention only and not for the purpose of limiting same, the drawings show a brassiere A, primarily a pre-natal brassiere, having a body encircling band 10 connected at the back portion by an appropriate fastener 12, illustrated as a Velcro fastener. Shoulder straps 20, 22 are secured to plastic hangers 30, 32 and are adjustable in length by standard components 40, 42. Cup B, C each are provided with contour producing seams S which are used to join two adjacent fabric sections at a contoured seam to produce the protruding, breast supporting or receiving cups B, C, in accordance with standard brassiere design and assembly concepts. Cups B, C are essentially the same and are generally mirror images of each other; therefore, a detailed description of cup B employing the present invention will apply equally to fabric breast cup C.

Breast receiving and supporting cup B includes an inner body engaging segment or overlay 100 having a contouring seam 102 and an outer decorative or decorator segment or overlay 110 having a companion contour controlling seam 112. Seams 102, 112 correspond and lie adjacent to each other to form seam S. Segment 100 includes peripheral edges 104, 106 and 108. In a like manner, decorative segment 110 includes peripheral edge 114, 116 and 118. These edges overlie each other and are sewed together in an appropriate fashion indicated as stitching 120, 122.

Figure 4A:
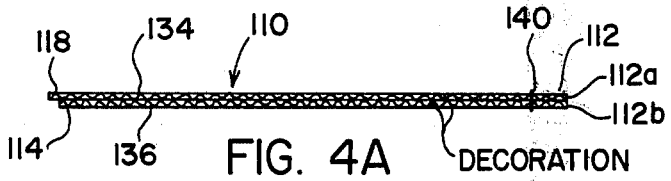
Figure 4B:
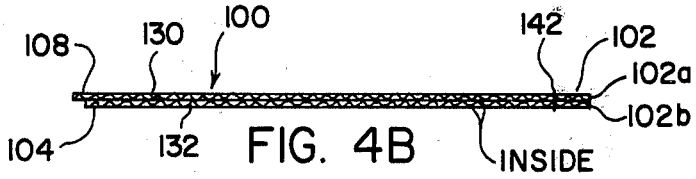

Segments or overlays 100, 102 are each formed from a pair of fabric sections 130, 132 and 134, 136, respectively. These fabric sections or cut so that the sections adjacent seams 102, 112, respectively, produce the desired contour for cup B after the fabric sections are joined together as shown in FIGS. 4A, 4B. Fabric of sections 130, 132, 134 and 136 are cotton cloth in the preferred embodiment with sections 130 and 132 being soft cotton fabric designed for comfort and sections 134 and 136 being cotton formed for decorative purposes, such as lace.

Figure 4C:
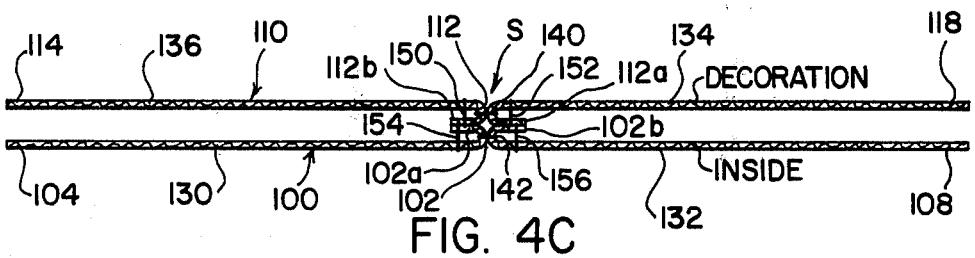

The present invention relates to an improvement in production of a contour producing seam of the cups B, C. The seam S is constructed in accordance with the process generally shown in FIGS. 4A, 4B and 4C. Referring now to FIG. 4A, sections 134, 136 are cut so that seam 112 can be stitched together by stitching 140. This produces marginal strips 112*a*, 112*b* which are somewhat minimized and are about 0.25 in width. In a like manner, stitching 142 along seam 102 produces marginal strips 102*a*, 102*b* of fabric sections 130, 132, respectively. This sewing concept is shown in FIGS. 4A, 4B. After seams 102, 112 have been formed, marginal strips 102*a*, 102*b* and 112*a*, 112*b* are spread in opposite directions away from stitching 140, 142, respectively. In a like manner, sections 130, 132 and 134, and 136 are spread so that stitching 150, 152, 154 and 156 can be used to finalize seams 102, 104, as shown in FIG. 4C.

In accordance with standard practice, segments or fabric overlap 100, 110 match each other to form cup B. In accordance with the present invention, marginal strips 102*a*, 102*b* and marginal strips 112*a*, 112*b* are assembled in a manner facing each other as shown in FIG. 4C. Thus, these marginal strips are captured between segments or overlays 100, 110 to prevent any protrusion of these strips from final seam S. Thereafter, matching, coterminous peripheral portions 104–108 and 114–118 are basted together to form cup B.

Figure 2:
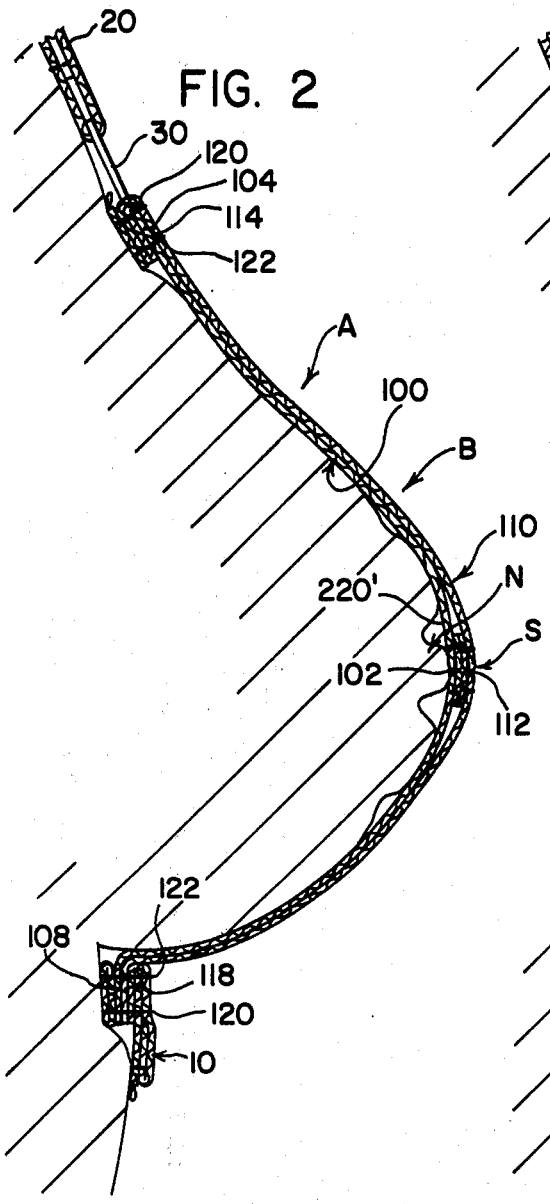
FIG. 2 is an enlarged cross-sectional view taken generally along line 2—2 of FIG. 1 and showing the relationship of the present invention with respect to a breast.
Figure 3:
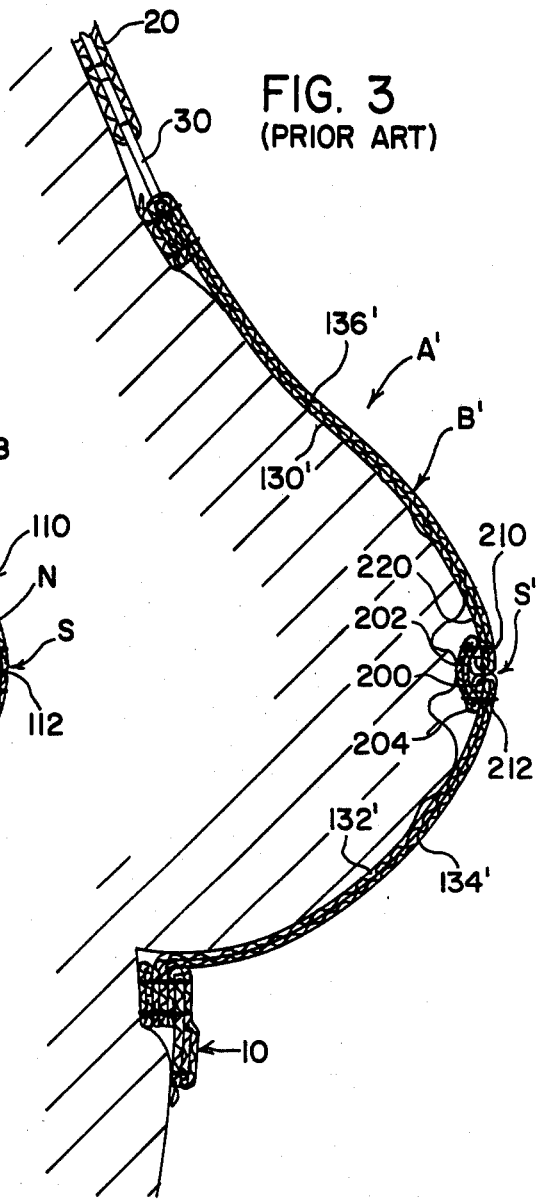
FIG. 3 (PRIOR ART)
FIG. 3 is a view similar to FIG. 2 showing the prior art to which the present invention is directed; and, FIGS. 4A, 4B and 4C are cross-sectional views showing operating steps in practicing the present invention.

By using the present invention, as discussed above, final seam S does not have an inner protrusion to form an irritant at the inner surface of cup B. Irritation to nipple N, as shown in FIG. 2, is avoided by using the new brassiere seam structure. Indeed, final seam S is formed by only four layers of fabric, in this instance cotton cloth. Referring now to FIG. 3, a prior art final seam S′ is illustrated for use in forming cup B′ of a pre-natal brassiere A′ formed from cotton material. In the past, sections 130′ and 136′ were cut and laid together. In a like manner, sections 132′ and 134′ were cut and laid together. Then stitching 200 sewed the four separate cotton sections together to form final seam S′. This produced an inwardly extending protruding portion 202 which was covered by a strip of bias type 204 and secured by stitchings 210, 212. As can be seen, this structure produces an inwardly extending protrusion across inner surface 220 of cup B′. No such inner protrusion is formed by using the present invention, as shown in FIG. 2. Surface 220′ of cup B is relatively smooth and does not have a ridge at final seam S. In prior art cup B′, four layers of fabric material extend inwardly of surface 220 to prevent outer disfiguration of final seam S′, as viewed from the right in FIG. 3. By using the present invention, the outer appearance of seam S, as shown in FIG. 2, is not distorted. There is no requirement for an inner protrusion to preclude the inner protrusion which can be an irritant for nipple N a source of discomfort for protrusion for the person wearing brassiere A′.

Having thus described the invention, the following is claimed:

1. In a brassiere of the type having breast receiving cups, each of which is formed from an inner body engaging fabric segment with an outer periphery and an outer decorative fabric segment with an outer periphery, wherein said segments are basted at their peripheries and are each formed from two sections of fabric joined together at a common contour producing seam extending generally across said cup, the improvement comprising: said seam of each of said segments including a sewed joint between its two sections and defining inwardly folded marginal strips captured between said segments at said contour producing seam.

2. The improvement as defined in claim 1 wherein said body engaging fabric segment is formed of two sections of natural fiber fabric.

3. The improvement as defined in claim 2 wherein said natural fiber is cotton.

4. The improvement as defined in claim 3 wherein said decorative segment is formed at two sections of cotton fabric.

5. The improvement as defined in claim 1 wherein said decorative segment is formed at two sections of cotton fabric.

6. The improvement as defined in claim 1 including means generally parallel with said joint and along said marginal edges for holding said marginal edges generally flat against said sections.

7. The improvement as defined in claim 6 wherein said holding means is a stretching of thread.

8. The improvement as defined in claim 6 wherein said body engaging segment is formed of two sections of cotton fabric.

9. The improvement as defined in claim 8 wherein said decorative segment is formed at two sections of cotton fabric.

10. A method of making a brassiere of the type having breast receiving cups, each of which is formed from an inner body engaging fabric segment with an outer periphery and an outer decorative fabric segment with an outer periphery, wherein said segments are each formed from two sections of fabric joined together at a common contour producing seam extending generally across said cup, which method comprises the steps of:

(a) placing said two sections of a segment together with common marginal edge portions overlying each other;

(b) sewing said sections together at a joint to form marginal edge portions beyond said joint;

(c) opening up said segments into contoured cup portions; with said marginal edge portions facing away from said joint;

(d) placing said cup portions together with said marginal edge portions facing each other and said joints and peripheries coextensive; and, (e) basting said peripheries to form a brassiere cup.

* * * * *